US009427063B2

(12) United States Patent
Farrar et al.

(10) Patent No.: US 9,427,063 B2
(45) Date of Patent: Aug. 30, 2016

(54) COMPACT LIQUID CONTAINER

(75) Inventors: Peter Antony Farrar, West Yorkshire (GN); John Hein, West Yorkshire (GB)

(73) Assignee: BREEZE PRODUCT DESIGN LIMITED, West Yorkshire (GB)

( * ) Notice: Subject to any disclaimer, the term of this patent is extended or adjusted under 35 U.S.C. 154(b) by 19 days.

(21) Appl. No.: 13/818,162

(22) PCT Filed: Aug. 25, 2011

(86) PCT No.: PCT/GB2011/051607
§ 371 (c)(1),
(2), (4) Date: May 30, 2013

(87) PCT Pub. No.: WO2012/025758
PCT Pub. Date: Mar. 1, 2012

(65) Prior Publication Data

US 2013/0269830 A1 Oct. 17, 2013

(30) Foreign Application Priority Data

Aug. 26, 2010 (GB) ..... 1014223.0

(51) Int. Cl.
*A45D 34/00* (2006.01)
*A45D 34/02* (2006.01)
*B05B 11/00* (2006.01)

(52) U.S. Cl.
CPC ..... *A45D 34/00* (2013.01); *A45D 34/02* (2013.01); *B05B 11/0043* (2013.01); *B05B 11/0048* (2013.01); *B05B 11/0056* (2013.01); *A45D 2200/25* (2013.01); *B05B 11/30* (2013.01)

(58) Field of Classification Search
CPC ..... A45D 34/00; B65B 1/04
USPC ..... 141/2, 6, 22, 23, 113, 156, 157, 321, 141/330, 349; 222/212
See application file for complete search history.

(56) References Cited

U.S. PATENT DOCUMENTS 1,914,791 A * 6/1933 Schmitt et al. ..... 222/209
2,853,210 A * 9/1958 Cooprider et al. ..... 222/207
(Continued)

FOREIGN PATENT DOCUMENTS

EP 126718 A2 * 11/1984
FR 2630712 A1 * 11/1989 ..... B65D 47/28
(Continued)

*Primary Examiner* — Mark A Laurenzi
*Assistant Examiner* — Andrew Schmid
(74) *Attorney, Agent, or Firm* — Huffman Law Group, PC

(57) ABSTRACT

The present invention relates to a container system for liquids such as spray fragrances. The system includes a parent container (110) and a child container (120). The parent container provides a first cavity (113) for confining a liquid, and couples detachably to the child container for refilling the child container through a supply opening (111) in the parent container, so that the child container can be used for instance as a travel pack in a handbag or hand luggage. Here the child container is a compact dispenser, comprising a bowl-shaped rigid container (221) having a refill opening (222), which is kept closed by a valve unless the dispenser is connected to a supply container, and a dispense opening (224). These openings are located with a spacing from each other, and a pump (225) dispenses liquid from the dispense opening (224). In this particularly simple construction, the opening of the bowl is covered by a deformable membrane (227) to form a closed dispense cavity (226), the cavity becoming mainly or completely evacuated as the dispensing means is operated. The membrane then relaxes again, filling the dispenser, when the dispenser is re-applied to the parent container.

15 Claims, 10 Drawing Sheets

(56) References Cited

U.S. PATENT DOCUMENTS

| | | | | |
|---|---|---|---|---|
| 3,142,319 | A * | 7/1964 | Albert et al. | 141/113 |
| 3,181,737 | A * | 5/1965 | Chaucer | 222/136 |
| 3,270,525 | A * | 9/1966 | Sellers | 63/1.15 |
| 3,507,586 | A * | 4/1970 | Kutik et al. | 417/480 |
| 4,458,830 | A * | 7/1984 | Werding | 222/131 |
| 5,190,190 | A * | 3/1993 | Fudalla | 222/105 |
| 5,292,033 | A * | 3/1994 | Gueret | 222/95 |
| 5,306,125 | A * | 4/1994 | Weag | 417/472 |
| 5,333,761 | A * | 8/1994 | Davis et al. | 222/212 |
| 5,462,099 | A * | 10/1995 | Demarest et al. | 141/3 |
| 5,524,680 | A * | 6/1996 | de Laforcade | 141/18 |
| 5,623,974 | A * | 4/1997 | Losenno et al. | 141/20 |
| 5,871,126 | A * | 2/1999 | Bennett et al. | 222/207 |
| 5,875,936 | A * | 3/1999 | Turbett et al. | 222/207 |
| 6,062,437 | A * | 5/2000 | Mascitelli | 222/212 |
| 6,435,231 | B1 * | 8/2002 | Cooper et al. | 141/346 |
| 6,607,012 | B2 * | 8/2003 | Yquel | 141/20 |
| 6,910,603 | B2 * | 6/2005 | Smith | 222/153.13 |
| 6,997,219 | B2 * | 2/2006 | Py et al. | 141/314 |
| 7,665,635 | B2 * | 2/2010 | Ramet et al. | 222/321.7 |
| 8,079,388 | B2 * | 12/2011 | Turgeman | 141/113 |
| 8,596,501 | B2 * | 12/2013 | Hagleitner | 222/207 |
| 8,662,116 | B2 * | 3/2014 | Dumont et al. | 141/113 |
| 8,695,896 | B2 * | 4/2014 | Tu | 239/333 |
| 8,739,839 | B2 * | 6/2014 | Muller | 141/18 |
| 2004/0069810 | A1 | 4/2004 | Whitmore | |
| 2005/0016622 | A1 * | 1/2005 | Risch et al. | 141/113 |
| 2005/0284891 | A1 | 12/2005 | Ramet et al. | |
| 2008/0251541 | A1 * | 10/2008 | Cornet et al. | 222/209 |
| 2009/0194191 | A1 * | 8/2009 | Turgeman | 141/18 |
| 2010/0032451 | A1 * | 2/2010 | Neuhaus et al. | 222/207 |
| 2010/0310426 | A1 * | 12/2010 | Campbell et al. | 422/100 |
| 2011/0061764 | A1 * | 3/2011 | Springer | 141/1 |
| 2011/0139825 | A1 * | 6/2011 | Houghton | 222/207 |
| 2011/0297275 | A1 * | 12/2011 | Farrar et al. | 141/113 |
| 2012/0103926 | A1 * | 5/2012 | Ibsies | 215/228 |
| 2013/0269830 | A1 * | 10/2013 | Farrar et al. | 141/27 |
| 2014/0137983 | A1 * | 5/2014 | Tu | 141/113 |

FOREIGN PATENT DOCUMENTS

| | | | | |
|---|---|---|---|---|
| FR | 2802447 | A1 * | 6/2001 | B05B 11/02 |
| GB | 498106 | | 1/1939 | |
| GB | 1258590 | | 12/1971 | |
| GB | 2083142 | | 3/1982 | |
| WO | WO 9726997 | A1 * | 7/1997 | B05B 11/00 |
| WO | WO9726998 | | 7/1997 | |
| WO | WO2004052425 | | 6/2004 | |
| WO | WO2004073873 | | 9/2004 | |
| WO | WO2007062824 | | 6/2007 | |

* cited by examiner

COMPACT LIQUID CONTAINER

This application is a national stage application of International patent application no. PCT/GB2011/051607, filed Aug. 25, 2011. This application also claims priority to Great Britain Patent Application No. 1014223.0, filed Aug. 20, 2010.

The present invention relates to a liquid container, in particular to a liquid container system with a dispensing mechanism, and to a liquid dispensing system and method of using the liquid container.

Conventionally, many liquid products, for example perfume, liquid soap, moisturiser, etc., are sold in containers equipped with a delivery mechanism that dispense a controlled amount of the content of the containers, the most common being a pump mechanism which, when pressed, delivers the product in its original liquid form, or in the form of mist or foam. The design of the container and delivery mechanism is central to such a product, as the aesthetics of the container often draw in custom, and a well-designed dispensing system not only adds to the aesthetics of the product, but ensures that the optimal amount of the liquid content is delivered to the user in a desirable form.

However, it is often inconvenient for the user to transport a liquid product in its "standard pack" container when travelling or for overnight stays, or, especially for perfume and after-shave, to carry the product in handbags or briefcases. In some cases, it would even be impossible for the user to transport a product in its standard pack, for example because of restrictions imposed on hand baggage for air travellers.

The user often resorts to transferring an amount of the liquid product from its original container to a smaller container, which is an inconvenience to the user, and often results in spillage or contamination. For some products, it may not be possible for the user to transfer the content from the original container to another container, for example if the original container is sealed and the content is to be dispensed as mist or foam.

Manufacturers of liquid products may provide the products in smaller "travel packs", but it may not be cost-effective to incorporate the same delivery mechanism used in a standard pack into the smaller, and so necessarily cheaper, travel pack.

The discrepancy of delivery mechanism between the standard pack and the travel pack of a product is undesirable for the manufacturers, especially for luxury brand products for which packaging is an important aspect of the product. Moreover, travel packs by design are not intended for long-term use, and so are wasteful of resources.

U.S. Pat. No. 7,066,674 (L'Oréal) discloses a device for applying a liquid product, comprising a receptacle for containing the liquid, and a removable unit configured to be removably positioned on the receptacle. An application element (such as a sponge or a felt) for applying the liquid is housed within the removable unit. When the removable unit is positioned on the receptacle, the application element can be loaded with the liquid from the receptacle by actuating a suitable mechanism such as a pump.

However, the removable unit of the device of U.S. Pat. No. 7,066,674 is only able to retain a small amount of the liquid product limited by the application element. Thus, as described therein, the removable unit is only capable of a few applications. Moreover, after the application element is loaded, the liquid will inevitably evaporate, and a user may find him/herself in situations where the removable unit is removed and taken away for later application without the user realising that the liquid product has evaporated or the application element has not been loaded. Also, designs of this kind do not solve the problem of incorporating a dispensing unit, such as a spray, in a travel fixture.

It is therefore desirable to provide a liquid container that can accommodate travel requirements, while minimising wastage of resources and preserving the consistency of products, which is simple and convenient to use.

In their earlier application WO 2010/094963 the inventors have disclosed a two-part liquid container system that comprises a parent container for containing the main reservoir of liquid and a refillable child container for containing and dispensing liquid, which can be attached to the parent container for normal use, drawing liquid from the parent container, or for refilling, and can be detached from it for easy transport. The parent container provides a first cavity for confining a liquid, and is configured to couple detachably to the child container for refilling the child container through a supply opening in the parent container. The child container provides a second cavity for confining a liquid, and comprises a dispensing mechanism for dispensing liquid from the second cavity through a dispense opening, and a fluid transfer assembly, preferably including a valve assembly, for controlling liquid flow from the parent container into the child container through a refill opening. The first valve assembly is configured to form a channel between the first cavity and the second cavity to allow liquid flow when the parent container is coupled to the child container. The container system further includes a movable part which, in one direction of travel, urges liquid from the parent container to the child container, coupling of the child container to the parent container leading to movement of the movable part so as to cause an amount of liquid to pass from the first cavity into the second cavity, ensuring that the child container is filled when connected to the parent container.

The moving part, such as a piston or a bellows arrangement, is preferably in the child container, which preferably further comprises a restoring means that stores a restoring force as liquid is expelled from the second cavity by the dispensing mechanism. When the child container is separated from the parent container, dispensing of liquid causes the second cavity to contract, the moving part being connected to, or forming part of the wall of, the second cavity. When the parent container and the child container are coupled together again, the restoring means releases the restoring force so as to expand the second cavity to the original state, urging the moving part back to its initial position, thereby drawing liquid from the first cavity, in the parent, into the second cavity, in the child.

With the earlier invention a travel or "child" container can thus be recharged a large number of times from a "parent" container containing liquid at atmospheric pressure. Moreover, this happens automatically whenever the two are coupled together, even though the liquid is not under pressure. Meanwhile, the coupled container system can be used as a unit in the familiar way.

The present invention represents a further development of this idea and is concerned with a child container as claimed in claim 1. Here the moving part and the restoring means can be one and the same, namely a membrane which partly defines the cavity in the child container ("second cavity"). The former application does disclose a membrane embodiment, namely in FIG. 9. However, here the membrane 127*c* is so to speak radial—that is, across the direction of liquid flow from the inlet to the outlet of the (child) container. This means that it has to be penetrated by or connected to the tube or needle 123*c*. As a consequence, in the first place, manufacture and maintenance of a seal is not easy, and in the second place, the membrane's freedom to move and flex is considerably constrained. In the present invention, by contrast, the membrane helps to define a cavity adjacent to the refill opening; that is, the membrane is not penetrated by the liquid as the cavity is being filled from the main container.

Containers for liquids with squeezable membranes are known—see for instance GB 498106 (R. Bergerioux) or WO 2004/052425 (Purgo Creations), but the membrane is not used in a child container for refilling it.

If the cavity is of a simple shape, with no sharp angles or recesses, the membrane, if sufficiently elastic, can deform so as to empty the cavity virtually completely, reducing waste and allowing a compact format of the child container. Moreover, the seal is easy to make, being fixed, and no sliding parts are necessary.

The membrane can be made of any suitable material, such as rubber or synthetic rubber, provided that it is proof against the liquid used, and in particular the solvent, in the case of a fragrance.

The cavity can be in the form of a shallow cylinder, with the large "drum" face, or one of them, occupied by the membrane stretched across it, and the liquid entering and leaving more or less across the diameter. As the container is emptied, the membrane is sucked in until is covers the floor and sides of the cavity. The edge of the drum opposite the membrane should be rounded off, to allow the membrane to lie flat against the rigid inner surface of the cavity. In general, if the cavity has a shape in which one face is larger than the other or others, i.e. a large flat face, that face should be occupied by the membrane.

Alternatively the dispenser can be spherical, half being rigid and the other half being the membrane, whose rest configuration is a sphere, like a squash ball half. The membrane is deformed inwardly before the container is applied to the parent, to suck up a defined quantity of liquid.

For a better understanding of the present invention, various examples will now be explained with reference to the accompanying drawings, in which.

Figure 1A:
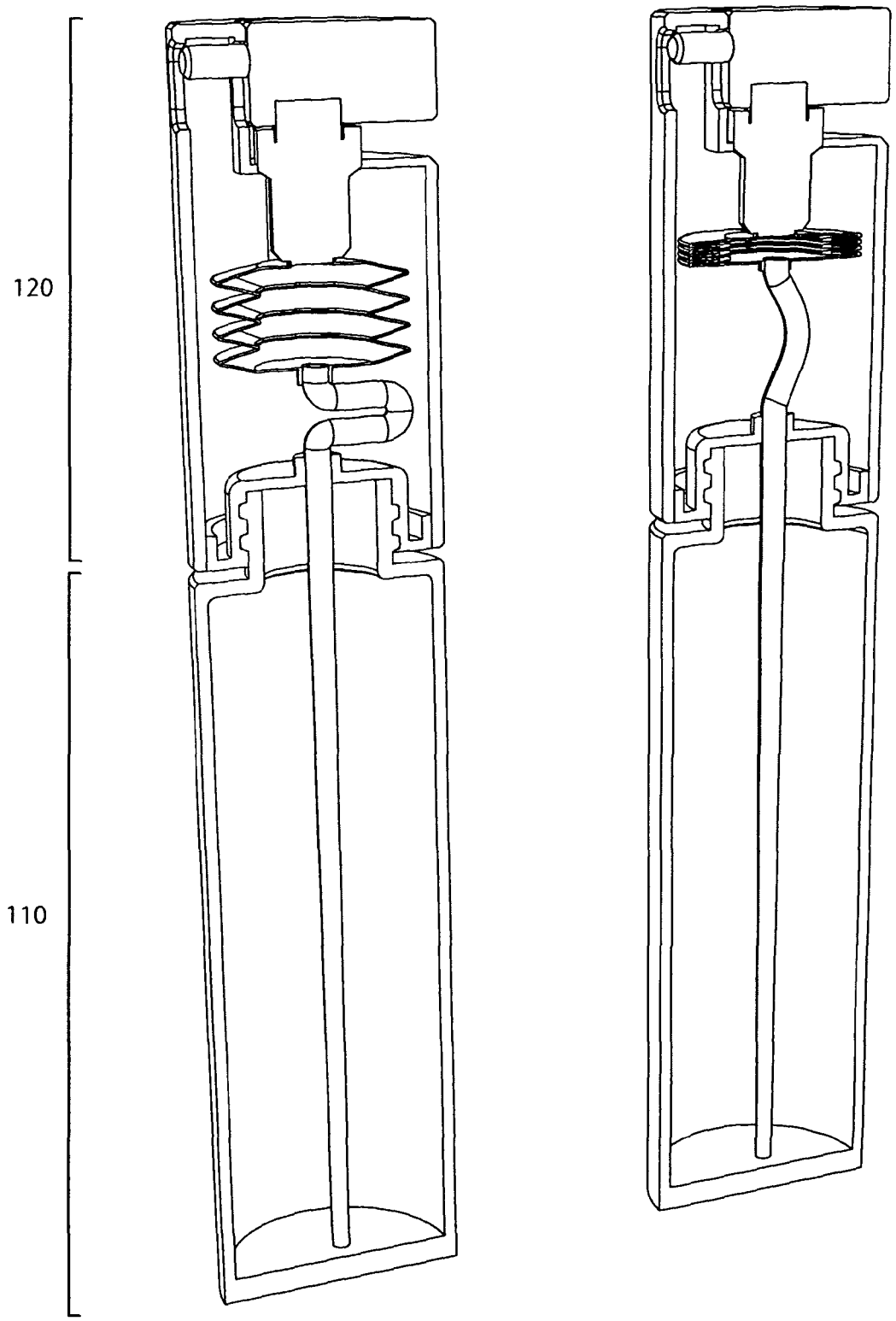
FIG. 1A shows a container system representing an embodiment in WO 2010/094963.
Figure 1B:
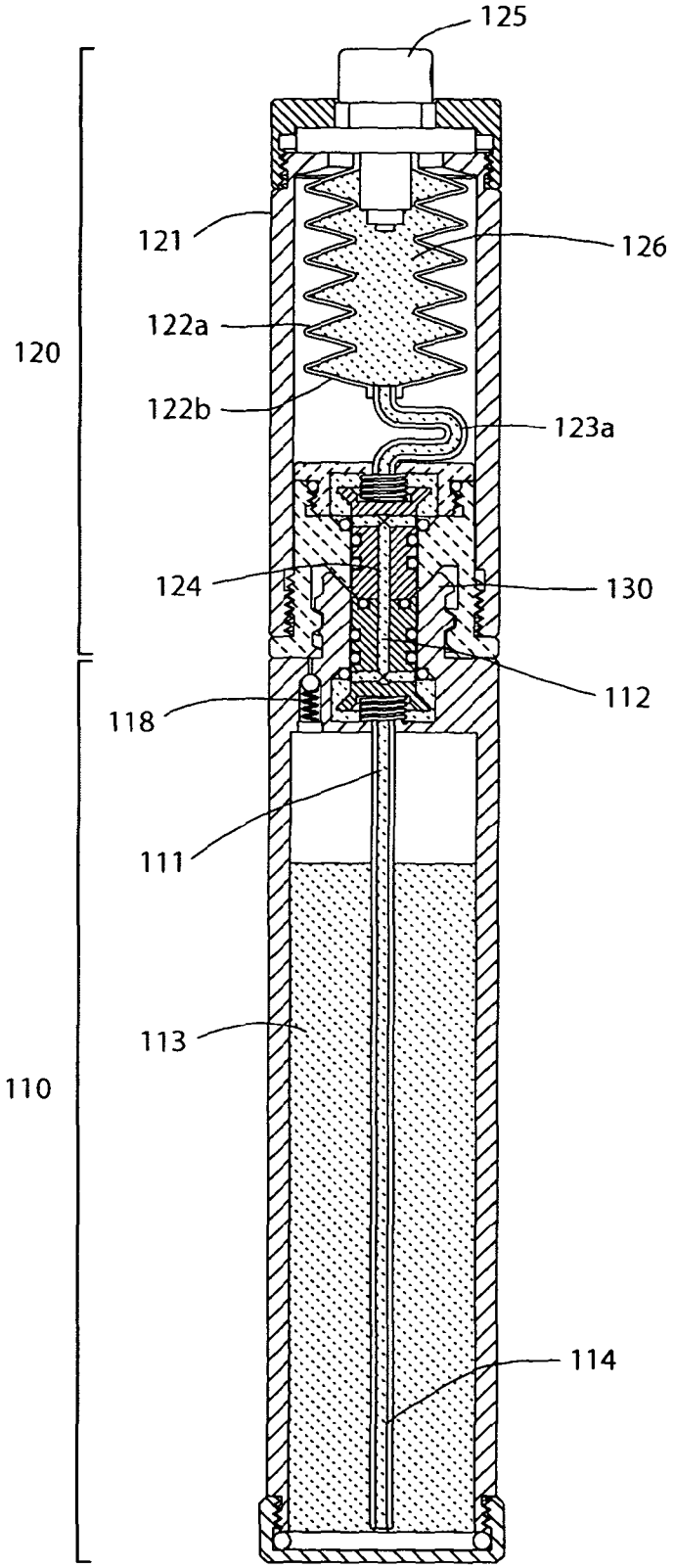
FIG. 1B shows a line drawing of the container system of FIG. 1A.

The general scheme to which the present invention relates is shown in FIGS. 1A and 1B as a bottle (liquid container system) 100, comprising a main body (parent container) 110, which can be made of glass, plastic or any suitable material, and a refillable cap portion (child container) 120, which is detachably secured to the main body 110 by means of a securing mechanism 130, here a screw thread, though it could also be, say, a bayonet or clip-on mechanism.

The main body 110 has an opening (supply opening) 111, which is occupied by or connected to a valve 112. When the main body 110 is separated from the cap portion 120 the valve 112 is closed, providing a sealed cavity 113 for confining a liquid therein. The cavity 113 holds a tube 114, which extends from the supply opening towards the bottom of the cavity 113, for extracting the liquid content from the cavity 113 through the tube 114. Air flow into the main body 110 is controlled by a one-way valve 118. The sealing valve 112 and the tube 114 form a valve assembly providing a passage from the cavity 113 to outside the main body 110 through the valve 112.

The cap portion 120 comprises a casing 121, which is typically metal or plastic. The casing 121 is in several parts, secured together, and provides a support structure for mounting the components of the cap portion 120 and can be in any shape or form. In particular, it can be designed in the same style as a simple cap for a main container having a spray head.

Within the casing 121, the cap portion 120 contains a collapsible container in the form of a bellows 122*a*. The bellows forms a collapsible chamber or compartment that can be expanded to draw in fluid through a valve and contracted to expel it through a suitable outlet such as a spray dispenser. The upper opening (the dispense opening) of the bellows 122*a* is coupled to a pump mechanism 125, thus creating a sealed cavity 126 inside the bellows 122*a*, in which a liquid can be confined. When the pump mechanism 125 is actuated, the content of the bellows 122*a* is expelled through the opening, in this case as a mist.

Initially the bellows is in a filled state with liquid in the cavity 126, as shown in FIG. 1B. The cap portion 120 can then be detached, whereupon the valve 124 seals. Since the bellows 122*a*, the valve assembly 123*a* and 124 and the pump mechanism 125 form a sealed system, when liquid is expelled from the cavity 126 by the action of the pump mechanism 125, the decrease in the volume of liquid causes the bottom 122*b* of the bellows 122*a* to be pushed upwards into the cavity 126 under atmospheric pressure, thus causing the bellows 122*a* to collapse. As the bellows collapses, an expansion force is built up in the bellows 122*a* as it is being compressed.

When it is desirable to refill the cap portion 120, or simply convenient to use the cap portion 120 and the main body 110 as a single combined unit, the cap portion 120 is placed onto the main body 110, and screwed into position by the securing mechanism 130. When the cap portion 120 is in position, the valve 112 of the main body 110 and the valve 124 of the cap portion 120 push against each other and force the valve bodies to retreat into the respective cavities, thus opening up a channel from the cavity 113 of the main body 110 into the cavity 126 of the bellows 122*a*. This channel is sealed by various O-rings as shown.

As a result of the valve 124 of the cap portion 120 being opened, the cavity 126 of the bellows 122*a* is no longer sealed. Thus, the force built up in the bellows 122*a* can now be released, allowing the bottom 122*b* of the bellows 122*a* to travel down and expanding the bellows 122*a* again. This results in a suction force that extracts liquid from the cavity 113 of the main body 110 by drawing air in through the air valve 118 in the main body 110. The liquid then travels through the tube 114, the valves 112 and 124, and the tube 123*a*, into the bellows 122*a*.

Note that the action of the bellows 122*a* drawing liquid from the main body 110 commences automatically as soon as the cap portion 120 is coupled to the main body 110 without further action or prompting from the user. In this way, the present invention ensures that the cap portion 120, which can be used separately from the main body 110, is always full when the user detaches the cap portion 120 from the main body 110 again. Thus, the user will never find him/herself in a situation where the cap portion 120 is taken away on holiday, only to discover that it is empty on arrival at the destination.

In addition, although the cap portion 120 can be used for dispensing the liquid product as a separate unit detached from the main body 110, it is likely to be used more often as a combined unit 100 in which the cap portion 120 is coupled to the main body 110 for reasons of convenience and easy storage. In this case, since the tube 114, the valve 112, the valve 124 and the tube 123*a* form a channel between the cavity 113 of the main body 110 and the cavity 126 of the cap portion 120, as the pump mechanism 125 is actuated, liquid is drawn directly from the main body 110, in a manner similar to a conventional spray bottle. Thus, it is more convenient for the user to use the product when there is no need to detach the cap portion 120 from the main body 110, for example, when using the product at home. During such operation the bellows 122*a* of the cap portion 120 is always full, until the main supply is exhausted.

When the cap portion 120 is detached, a spring provided in each of the valves 112 and 124 returns the respective valve to its original position. Since the valves 112 and 124 are being pushed away from their respective cavities 113 and 126, a temporary vacuum/low pressure is created in the cavities, which causes any liquid droplets that may have remained on the tip of each valve to be sucked back through the valves into the cavities, thus leaving both the main body 110 and the cap portion 120 dry.

Figure 2:
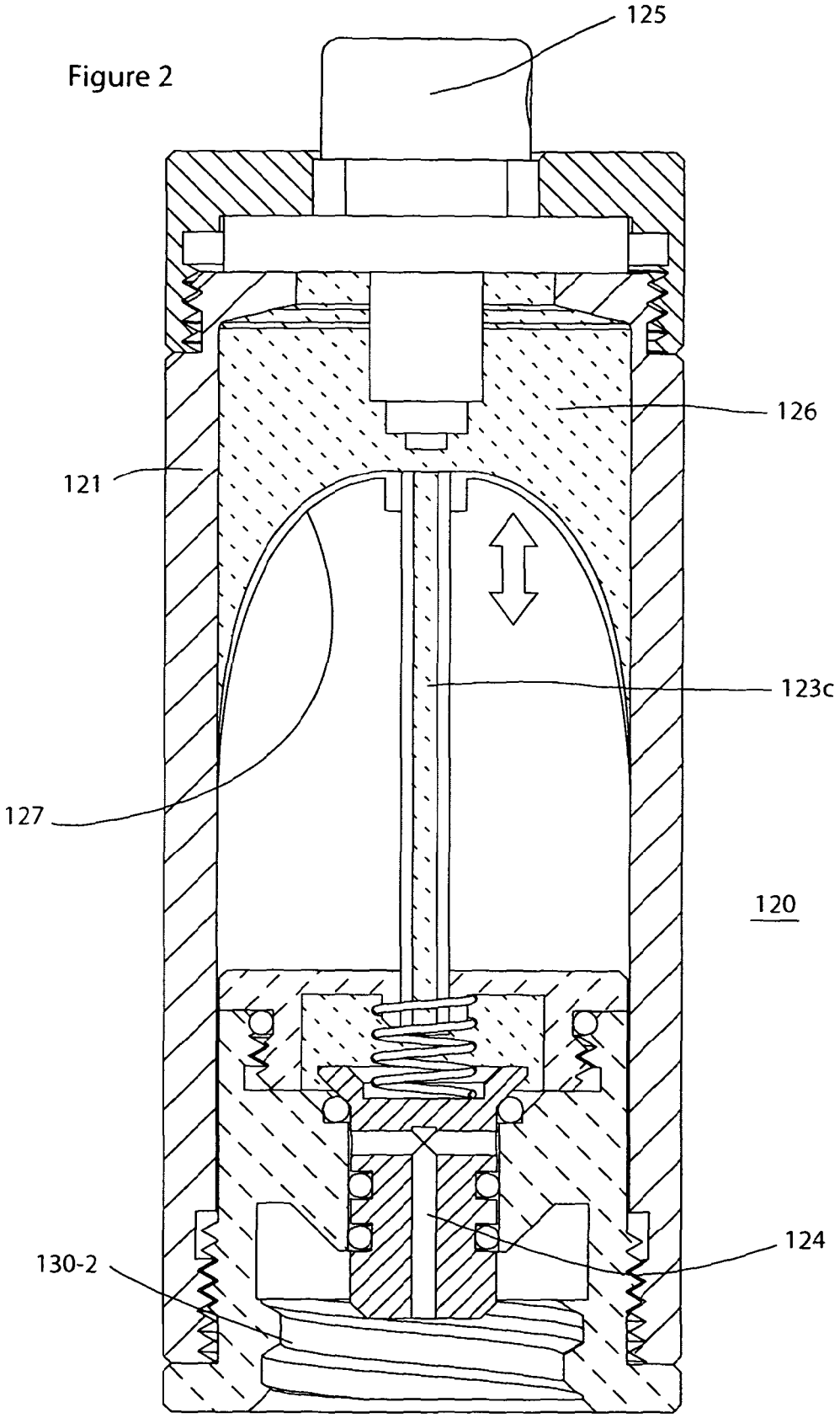
FIG. 2 shows the cap portion of a container system in the FIG. 9 embodiment of the earlier application.

A variant to the first type is shown in FIG. 2, where an elastic diaphragm 127 is attached to the inner wall of the casing 121 of the cap portion 120. The diaphragm defines a cavity 126 where liquid is confined, and the cavity 126 is sealed at one end by a valve 124 and at the other end by a pump 125. The diaphragm 127 is sealed around a central axial tube or needle 123*c* conducting liquid from the base region of the cap, at the valve, to the upper region. As liquid is expelled from the cavity 126 by the pump 125, the diaphragm 127 is pushed up into the cavity 126 under atmospheric pressure, thus stretching it. When the cap portion 120 is coupled to the main body 110, the valves 124 and 112 provide a sealed channel for liquid to travel freely between the cavity 113 of the main body and the cavity 126 of the cap portion 120, allowing the diaphragm 127 to release the stored elastic force, drawing liquid into the cavity 126. This corresponds to FIG. 9 of the earlier application.

Figure 3A:
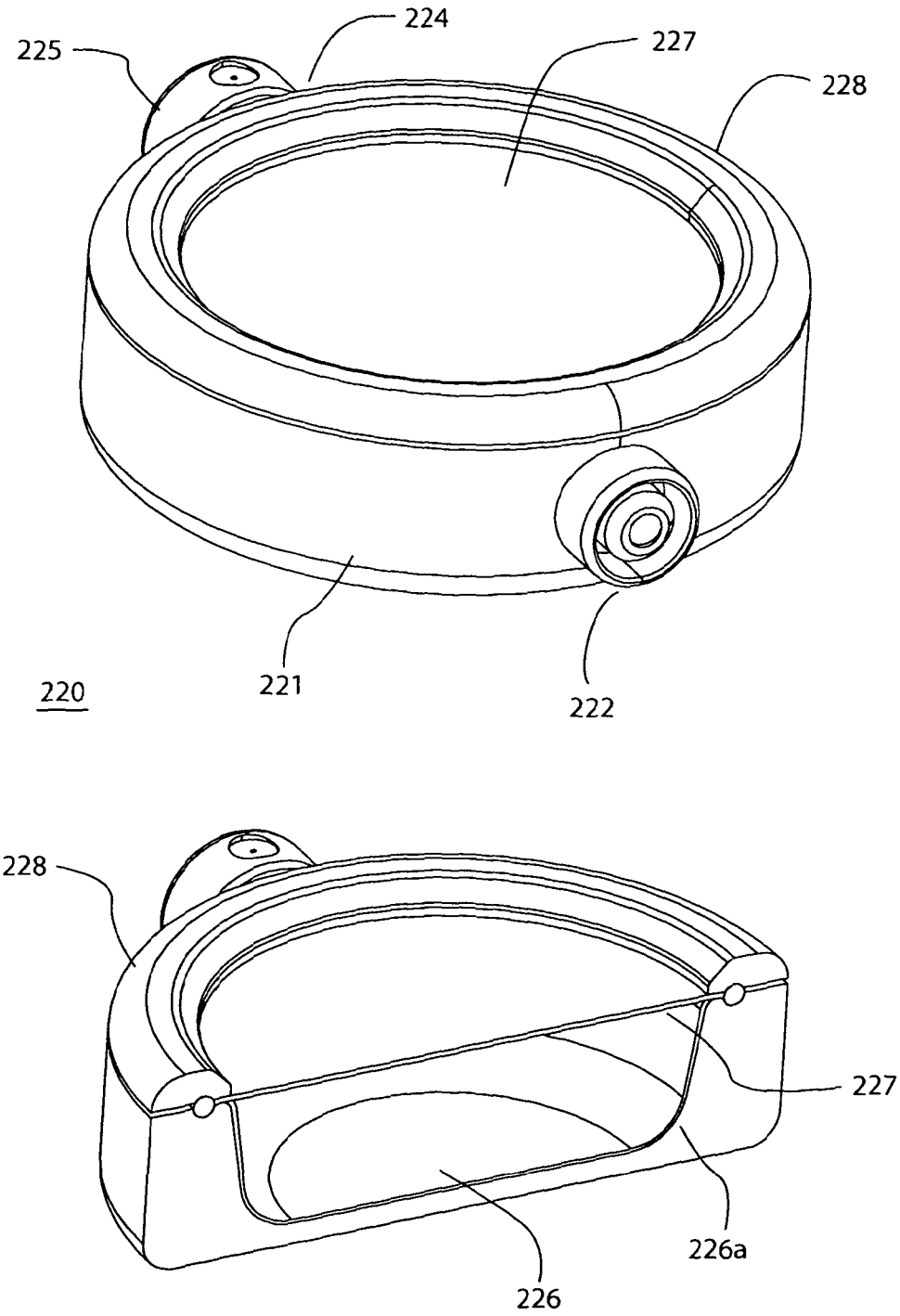
FIGS. 3A and 3B show an embodiment of the present invention.
Figure 3B:
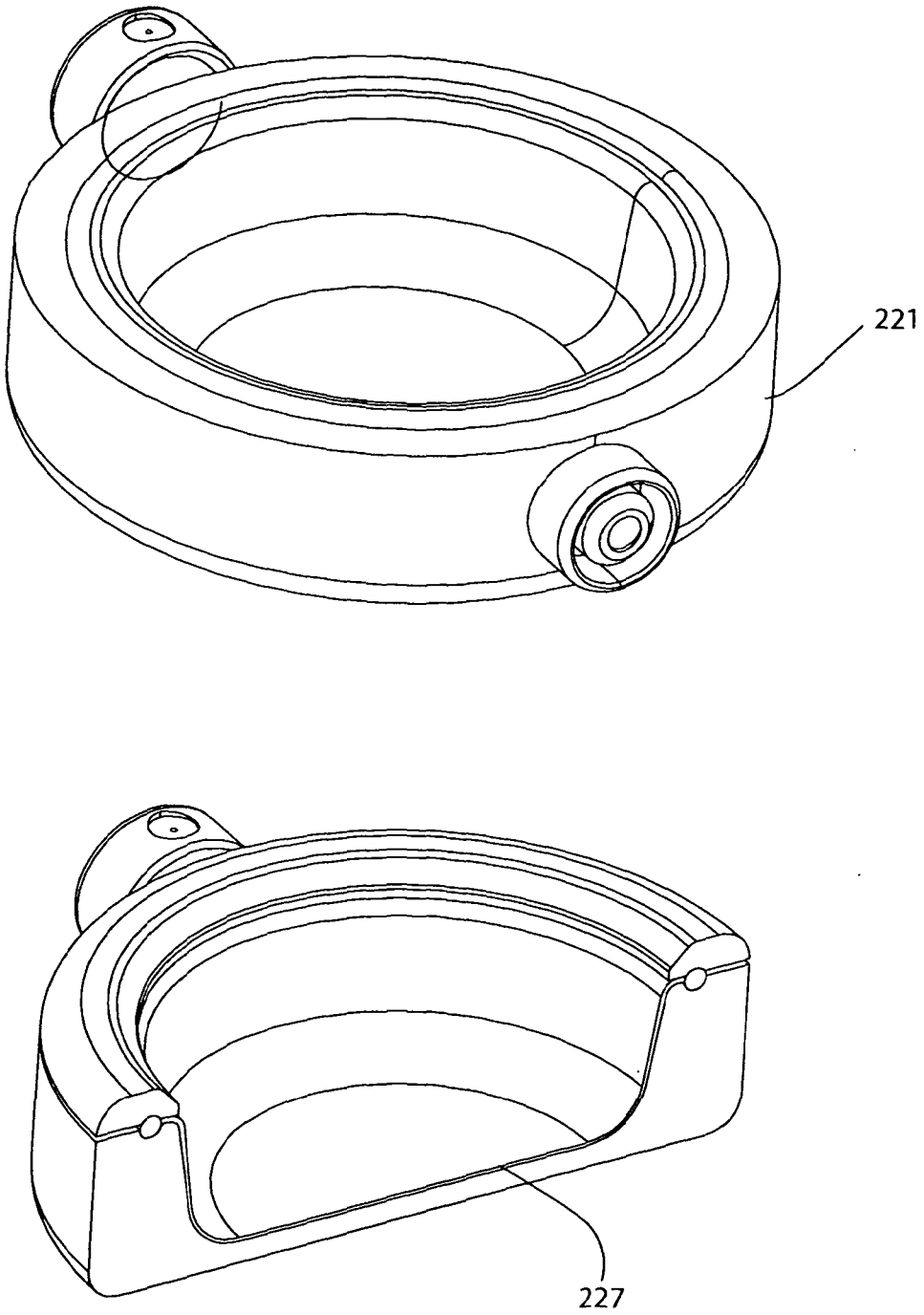

The present invention uses the same principle but with a different child container. An embodiment is shown in FIGS. 3A and 3B. The child container or cap portion 220 is in this purely arbitrary example in the shape of a shallow cylinder or pillbox, fluid entering at the side of the cylinder (which could be at the bottom in normal use) via a refill opening 222 and exiting diagonally opposite at a dispense opening 224 via a push-button pump 225. These items can be similar to those in other embodiments.

The child container, having this pillbox or drum shape, has two large faces of which one is visible in the drawing. The far face is solid in this embodiment, but the visible face is constituted over most of its area by a circular membrane 227 held in place by an O-ring 228*a* lying in a groove in the cylinder wall and itself pressed by a sealing ring 228.

The cavity 226 between refill and dispense openings is thus bowl-shaped. Preferably, the bottom edge of the bowl, indicated generally by the dotted line 226*a*, is not a sharp corner but is rounded, so that when the cavity is evacuated the membrane can lie closely against the solid walls of the cavity.

In operation, the child container 220 is filled by connecting it to the parent container (not shown here), the natural resilience of the membrane 227 serving as a restoring means to suck the liquid in, provided that the child container is initially evacuated (FIG. 3B) so that the membrane lies of the floor of the cavity. The dispenser, once filled as shown in FIG. 3A, can then be used with the child container in situ on the parent container. In this case, the membrane plays no significant part in the operation of the device.

However, if the child container is removed, a valve in the refill opening 222 closes and the child container operates as a stand-alone dispenser. As liquid is dispensed by the user pressing the pump 225, the membrane is drawn in to the bowl-shaped cavity. It has been found that the cavity can be more or less completely evacuated (less than 1%) as the pump is operated.

When the child container is re-applied to a parent container, the non-return valve in the refill opening 222 is opened and the membrane pulls back to its flat configuration, drawing liquid into the cavity.

The example here has a separate membrane held in place by a sealing ring. However, it would be possible to mould the membrane in place in situ, which would further improve the robustness of the device.

A further variant would be to make the membrane out of a somewhat thicker material but in a "flat-bellows" form; that is, having a stepped construction not unlike a Fresnel lens. This structure would be capable of deformation in a direction perpendicular to its plane so as to fulfil the same function as a stretching membrane.

The container need not be circular in shape as shown, but could be any shape as required by function or aesthetics. However, sharper internal corners should be avoided. In general, the membrane should be applied over a face of the cap portion that represents its largest dimension, so that the membrane does not have to deform perpendicularly to its face by more than, say, half its diameter.

Figure 4A:
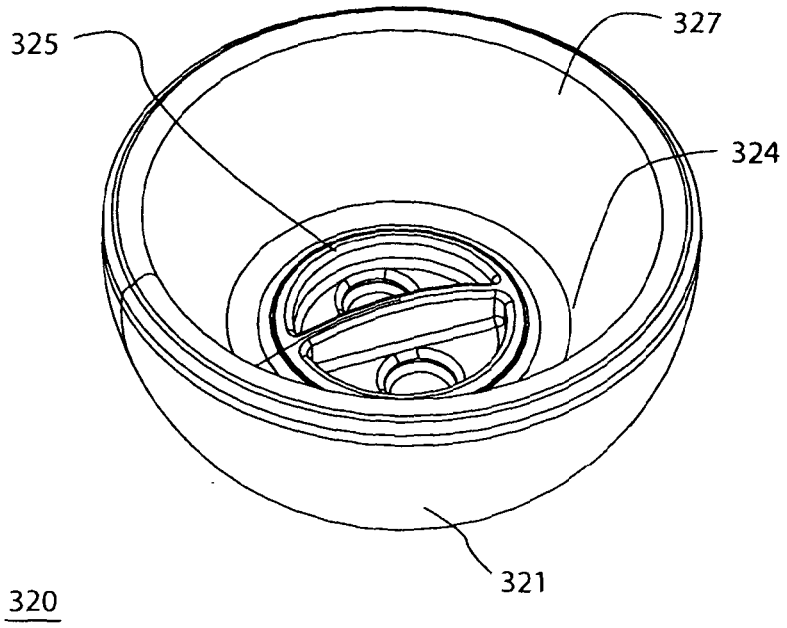
FIGS. 4 and 5 show a different embodiment, with the dispense valve on the membrane.

As well as being usable as a fragrance dispenser, the simple diaphragm option would be applicable wherever it is desirable to fill a smaller container from a very large container. For example, it is more convenient to transfer clothes washing liquid detergent from a large 5- to 10-liter container, which is difficult to lift and pour into a washing machine, into a smaller hand-sized container such as a detergent ball, which can then be put into the machine. An embodiment of this kind is shown in FIGS. 4 and 5.

Figure 4B:
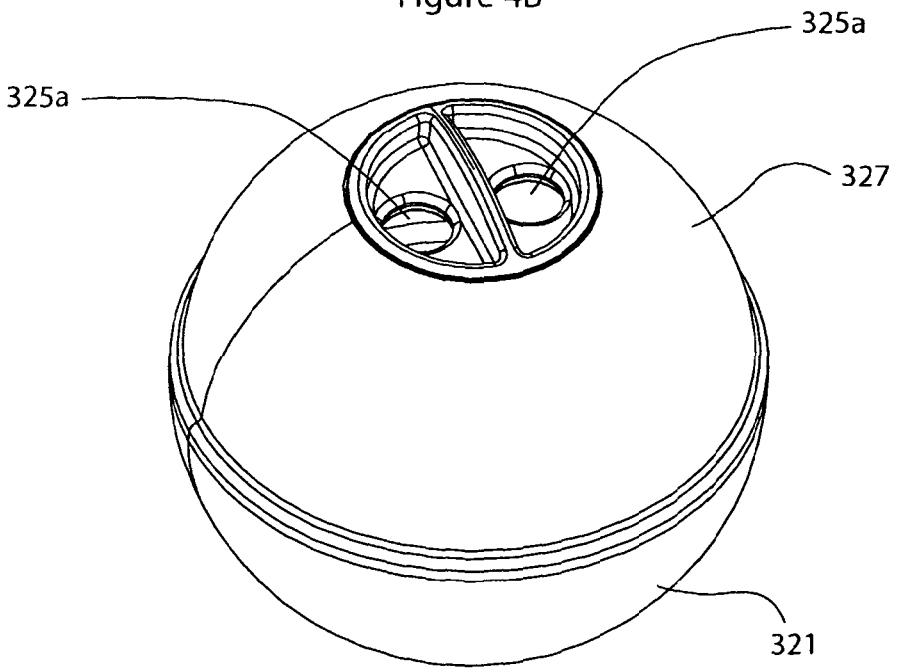
Figure 5:
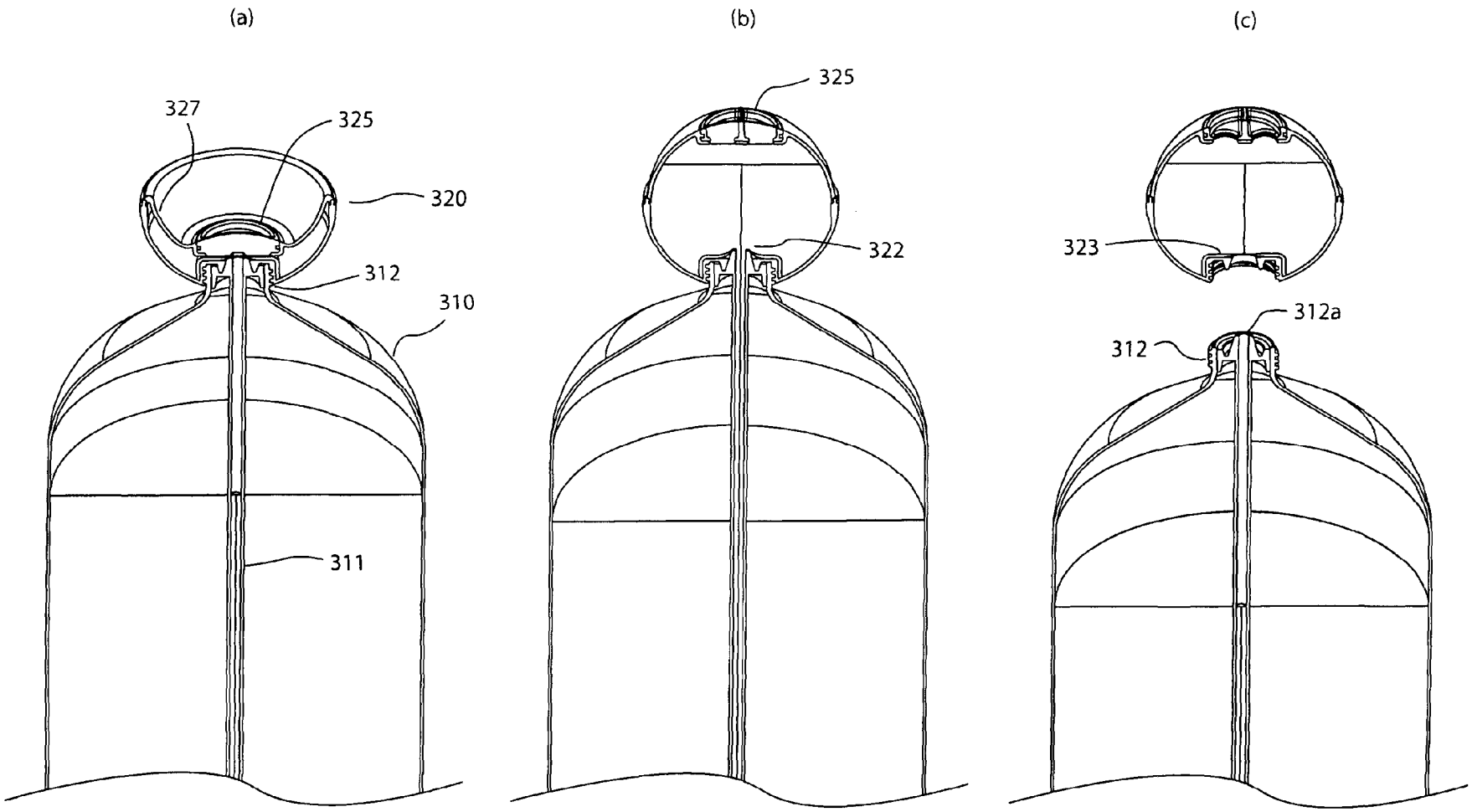

As shown in FIG. 4B, the ball has a rigid half-spherical side 321 and a domed diaphragm 327 forming the other half, sealed at the equator, so completing the spherical shape. The diaphragm 327 has mounted on it, at the pole, a manual valve 325 as a passive release mechanism. Theoretically this valve could be mounted in the rigid wall, but there is not much room, and the design shown is more intuitive to use.

The valve 325 is made of two plastic overlapping discs, each having two holes 325*a* located along a diameter. The discs are mounted so as to rotate about their common axes, so that when the pairs of holes line up the valve is open and when they have no overlap (i.e. at 90°) the valve is shut.

To fill the ball the user opens the valve, and squeezes the air out to the required volume of detergent required. He then closes the valve by turning the outer disc, so that the interior of the ball is sealed. This is shown in FIG. 4A. The ball is then attached to the large container, as shown in FIG. 5. This attachment opens the refill opening 322, as will be described, and the resilience of the membrane fills the child container 320, the compressed diaphragm expanding so as to fill the ball with the required amount of liquid.

When the ball is removed from the parent, as shown in FIG. 5 at (*c*), the refill opening 322 automatically closes again. The dispense opening of the ball is then opened again by turning the valve disc back, so as to allow liquid to pass from the ball into the machine during washing.

For "coarse" applications such as washing liquid, or any high-viscosity liquid, the valves do not have to seal 100%; here the valve in the refill opening can be simply in the form of a membrane covering an opening, the membrane itself having a small, perhaps star-shaped, perforation that is closed when the membrane is allowed to relax but is opened by a nose 312*a* of the connector piece 312 of the parent container, when the ball is applied to the connector piece.

In an alternative configuration the valve in the dispense aperture could be heat-operated and still be sealed when put into the machine, opening when it comes into contact with the warm water via a bimetallic strip opener for example, or just by the heating of the material.

It will be observed that even though the dispense opening can be in the membrane in this kind of embodiment, the refill process does not involve the liquid passing through the membrane. Thus in turn the full flexibility of the membrane can be used for the filling process.

Figure 6:
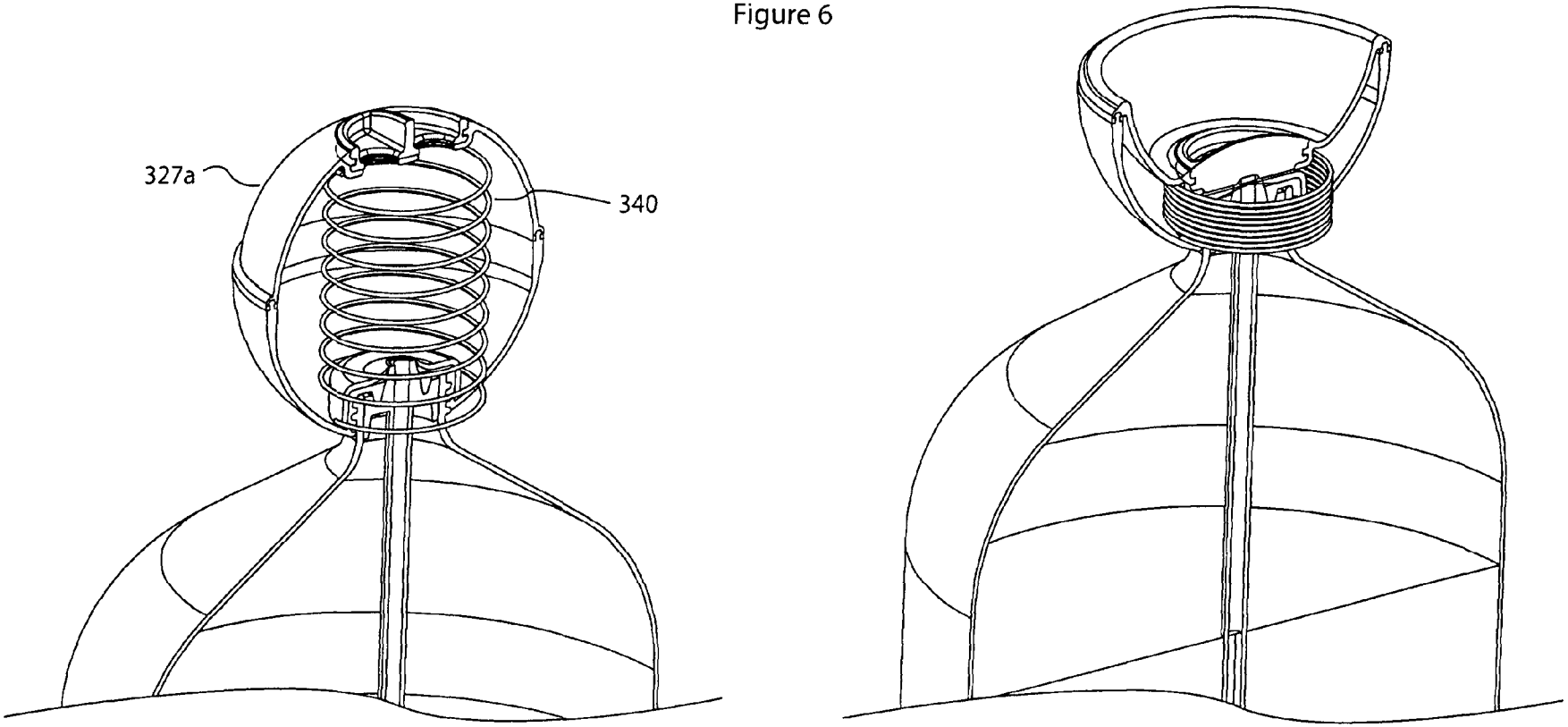
FIG. 6 shows a variant.

FIG. 6 shows a variant embodiment of the previous type, in which the natural resilience of the membrane 327*a* is at it were augmented by a spring 340. The spring extends from the refill opening to the dispense opening and urges them axially apart. The membrane 327*a* could even be completely flaccid, though that would probably be less acceptable from an aesthetic point of view.

If the diaphragm pack is used to fill a standard portable container from the mother, it would work in a similar manner to the fragrance pack. There would be a means to squeeze/pump/dispense the liquid out into a washing machine drawer and still maintain the vacuum inside.

Such an embodiment could work for any liquid where buying larger volumes—say over 5 liters—would make it preferable to transfer cleanly into much smaller manageable packs. Liquids could include Engine Oil, Petrol, Hair Shampoos/Conditioners, Shower Gels, Fruit Juices, Fruit Juice Concentrates etc. By having such large parent packs and possibly a high-value child pack, the material and therefore the environmental savings would be very high.

Figure 7:
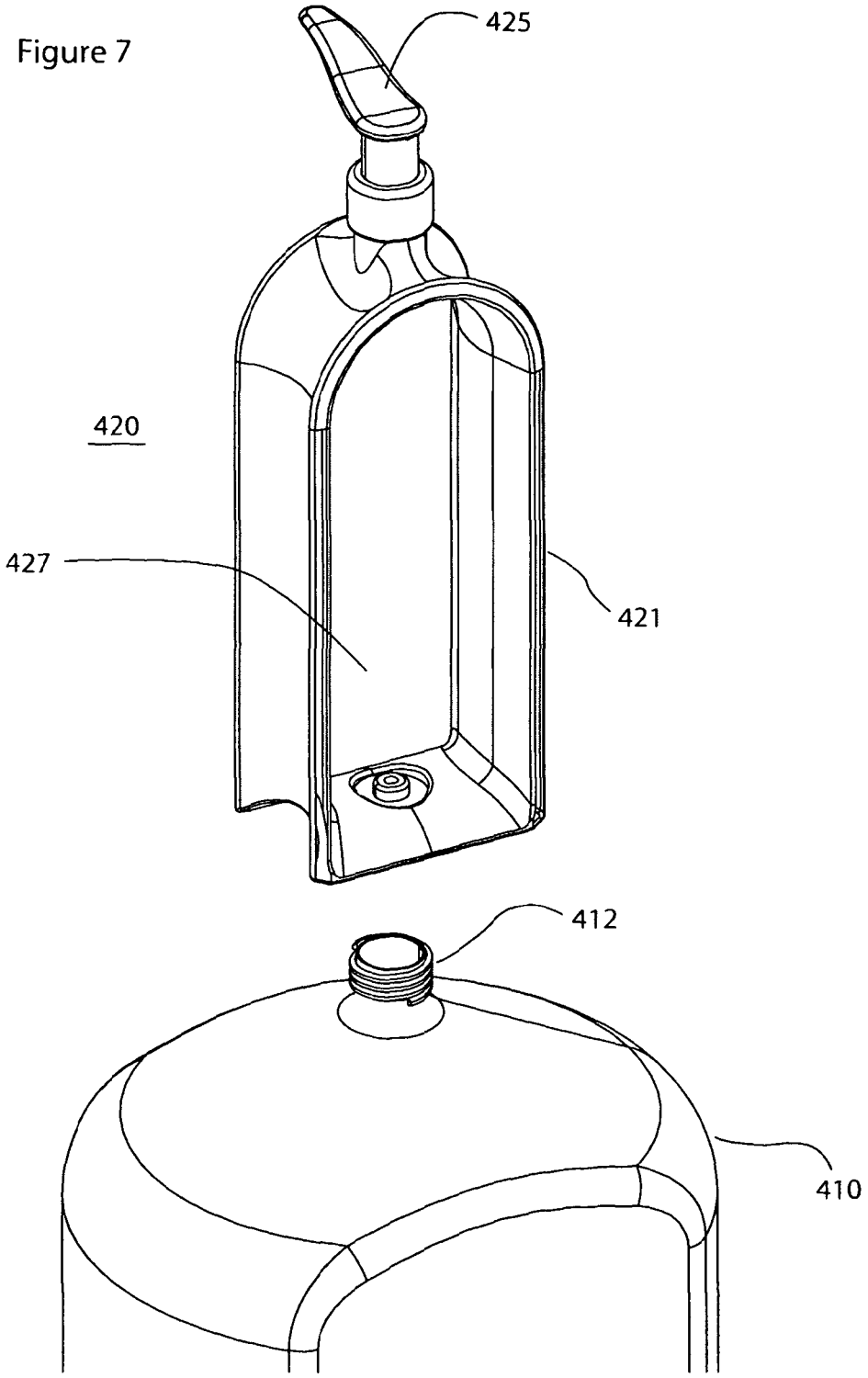
FIG. 7 shows a further embodiment in bottle form.

FIG. 7 shows a version in which the child container is a refillable bottle dispenser 420, such as can be used for soap. The generally flat body 421 has two membranes 427, one of which is visible, and a pump 425. The refill opening 422 is attached by a screw fitting on a connector piece 412 of the bottle 410, which can be similar to that of FIG. 5.

Figure 8:
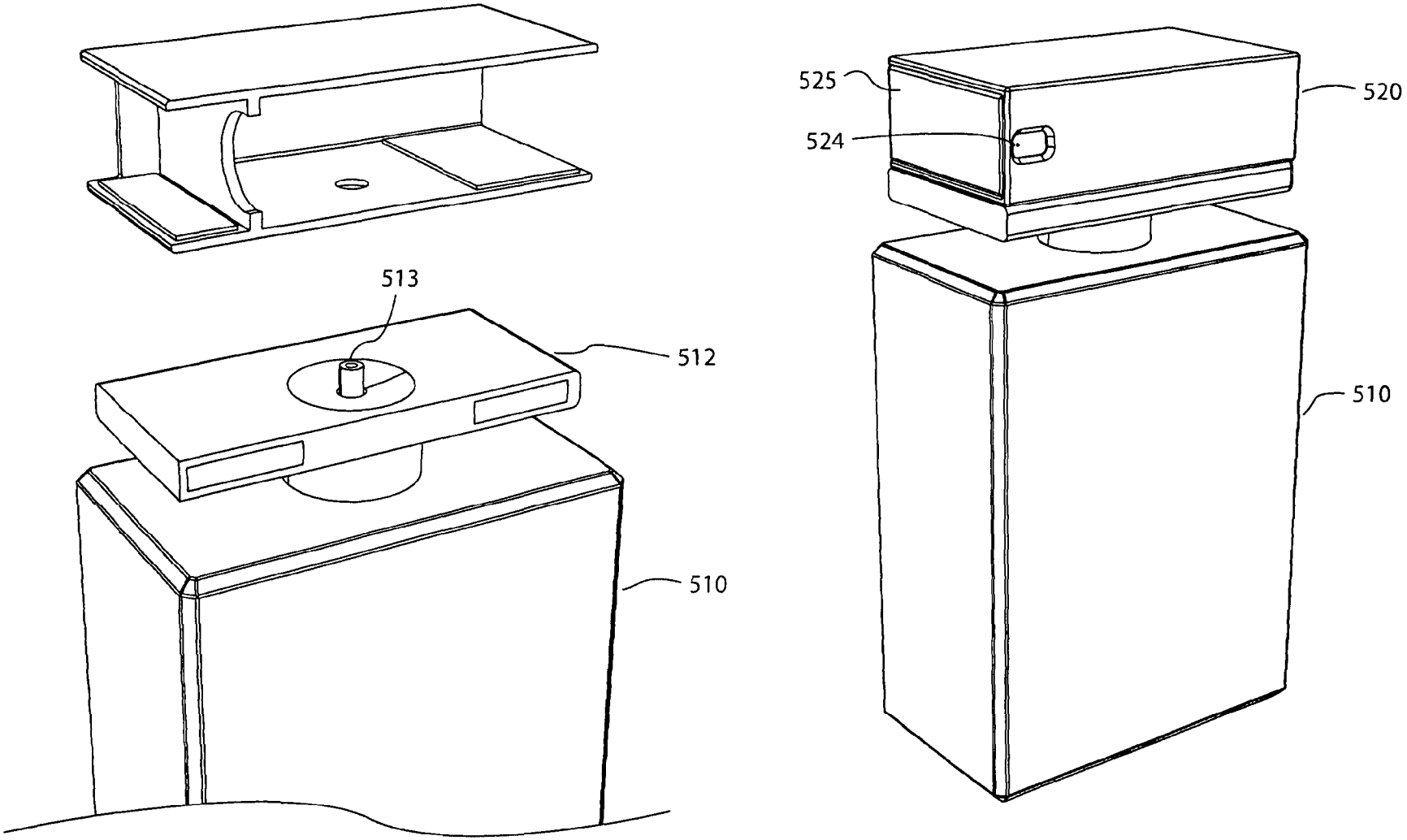
FIG. 8 shows an embodiment with a different connection system between parent and child.

FIG. 8 shows a yet further embodiment in which the connection between child and parent containers is magnetic. The general format of the containers is cuboid, the horizontal cross-sections being the same, as is the case with many perfume dispensers. The connection piece 512 of the parent is a rectangular magnetic plate, matching the general contours and penetrated in the middle by a tube 513 extending from the main perfume cavity in the parent 510. With the containers separated, the tube 513 is closed by a valve, not shown.

The body of the child container 520 is of steel, with a recess for the pump 525 and a larger recess containing the collapsible cavity. The latter may be in the form of a bellows, similar to that of FIG. 1, or a membrane container as in previous embodiments. Preferably the body 520 is not itself (ferro)magnetic, because otherwise it would tend to interfere with devices, such as credit cards, that are generally carried in handbags.

In fact, the body of the child could be of aluminium, or even plastics material, with an internal steel piece for the magnets to attract. This keeps the overall weight down. Preferably there are two simple mild steel plates inside the child product, directly in line with the magnets in the mother. The plates should match exactly the size and orientation of the magnets (and not the whole of the product surface) so as to provide a more definite positioning when the two elements are connected.

An advantage of a connection system of this type is its very low height compared to, say, a screw or catch connection.

In further embodiments, the main body may also be wholly or partly flexible, such as a sealed collapsible plastic bag, which can be implemented as a closed system. In this case, as the liquid content is being extracted from the main body, no air is let in to replace the volume of the extracted liquid; consequently the main body collapses under atmospheric pressure. This can be used as a cost-saving option for providing spill-free refill of a liquid product such as liquid soap.

It will be seen that the main body and the refillable portion do not necessarily form a single unit, and can be two independent containers. For example, the refillable portion can be a stand-alone consumer product such as luxury moisturiser, and the main body can be kept at specialist shops where the owner of a refillable portion may purchase a refill.

Other delivery systems may be used in the refillable portion to allow automatic or actuated slow release or shot release of the content, for example in place of dishwasher tablets.

The invention claimed is:

1. A free-standing dispenser (220; 320; 420; 520) for liquids, the dispenser comprising:

a bowl- or tray-shaped rigid container (221) with an open face, the container having a refill opening (222), which is kept closed by a valve unless the dispenser is connected to a supply container, and a dispense opening (224), these openings being located with a spacing from each other;

wherein the open face of the bowl is covered by a deformable resilient membrane (227) to form a closed dispense cavity (226) adjacent to the refill opening, the volume of this cavity being reduced as the membrane is deformed inwardly so as to empty the cavity, the refill and dispense openings being such that if the dispenser is applied to the supply container by way of the refill opening, with the cavity initially empty, when the membrane is subsequently allowed to spring back to its rest shape it draws liquid from the supply container into the cavity;

wherein the resilience of the membrane, when deformed, exerts sufficient negative pressure to suck liquid in from the supply container when liquid within the supply container is unpressurized;

wherein the dispenser is configured to be readily detached from the supply container for use;

wherein the dispenser is configured to automatically commence drawing liquid from the supply container into the cavity to refill or recharge the cavity as soon as the dispenser is attached to the supply container.

2. A dispenser according to claim 1, further including a pump (225) for dispensing liquid from the dispense opening (224), the cavity becoming mainly or completely evacuated as the pump is operated.

3. A dispenser according to claim 1, in which the rigid container is generally round in outline and the refill and dispense openings are located approximately at opposite ends of a diameter.

4. A dispenser according to claim 1, in which a lip of the bowl, defining the open face, has a groove and the membrane is retained in this groove by a sealing ring (228).

5. A dispenser according to claim 1, in which the membrane is integral with the bowl.

6. A dispenser according to claim 1, in which the dispenser (320) is generally spherical, the rigid container (321) being approximately a hemisphere and the membrane (327) approximately forming the other half of the sphere.

7. A dispenser according to claim 6, in which the dispense opening takes the form of a manual valve (325).

8. A dispenser according to claim 7, in which the manual valve (325) is located on the membrane (327).

9. A dispenser according to claim 1, and including an auxiliary restoring means (340) assisting the membrane to return to the full configuration.

10. A dispenser according to claim 1 and having the form of a flat-sided bottle (420), one or each flat side being constituted by a membrane (427).

11. A container system for liquids, including a parent container (110; 310) and a free-standing child container (220; 320), in which:

the parent container (110) provides a storage cavity (113) for confining a liquid;

the child container (220) is configured to be readily detached from the parent container (110) for use;

the child container (220) is further configured to be recoupled to the parent container (110) and to automatically commence drawing liquid from the parent container (110) through a supply opening (111) in the parent container (110) to refill or recharge the child container (220) as soon as the child container (220) is recoupled to the parent container (110);

the child container (220) is a dispenser having a refill opening (222), which is kept closed by a valve unless the child container (220) is connected to the parent container (110), and a dispense opening (224), these openings being located with a spacing from each other; and an open face of the child container (220) is covered by a deformable resilient membrane (227) to form a dispense cavity (226) adjacent to the refill opening, the volume of the dispense cavity being reduced as the membrane is deformed inwardly so as to empty the dispense cavity, the refill and dispense openings being such that if the child container is applied to the parent container by way of the refill opening, with the dispense cavity initially empty, when the membrane is subsequently allowed to spring back to its rest shape it draws liquid from the parent into the dispense cavity;

wherein the resilience of the membrane, when deformed, exerts sufficient negative pressure to suck liquid in from the supply container when liquid within the supply container is unpressurized.

12. A container system (100) according to claim 11, wherein the membrane urges liquid from the parent container (110; 310) to the child container (220; 320) when the child container (220) is coupled to the parent container (110), so as to cause an amount of liquid to pass from the storage cavity (113) into the dispense cavity (226), ensuring that the child container (220) is filled when connected to the parent container (110).

13. A container system according to claim 11, wherein the child is attached to the parent by a magnetic connection.

14. A container system for liquids, including a parent container (510) and a free-standing child container (520), in which:

the parent container (510) provides a storage cavity for confining a liquid, and is configured to refill the child container (520) through a supply opening in the parent container (510);

the child container (520) comprises a refill opening (522), which is kept closed by a valve unless the child container is connected to the parent container, and a dispense opening (524), these openings being located with a spacing from each other; and a dispense cavity (526) adjacent to the refill opening, whose volume is reduced as liquid is dispensed, the refill and dispense openings being such that if the child container is applied to a suitable parent container by way of the refill opening, with the dispense cavity initially empty, a resilient component draws liquid from the parent into the dispense cavity;

the resilience of the membrane, when deformed, exerts sufficient negative pressure to suck liquid in from the supply container when liquid within the supply container is unpressurized;

the connection between parent and child containers is magnetic, so that the child container is readily detachable from the parent container; and the child container is configured to reattach to the parent container, and once attached, to automatically commence drawing liquid from the parent container into the dispense cavity to refill or recharge the dispense cavity as soon as the child container is attached to the parent container.

15. A container system according to claim 14, wherein the child container (520) does not contain a ferromagnetic part.

* * * * *